US007816606B2

(12) United States Patent
Wiekhorst

(10) Patent No.: US 7,816,606 B2
(45) Date of Patent: Oct. 19, 2010

(54) TELECOMMUNICATION WIRE WITH LOW DIELECTRIC CONSTANT INSULATOR

(75) Inventor: David Wiekhorst, Potter, NE (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 118 days.

(21) Appl. No.: 12/171,378

(22) Filed: Jul. 11, 2008

(65) Prior Publication Data

US 2009/0078439 A1 Mar. 26, 2009

Related U.S. Application Data

(60) Provisional application No. 60/949,400, filed on Jul. 12, 2007.

(51) Int. Cl.
*H01B 11/02* (2006.01)

(52) U.S. Cl. ..... 174/110 R; 174/113 R

(58) Field of Classification Search ..... 174/113 R, 174/110 R, 120 R
See application file for complete search history.

(56) References Cited

U.S. PATENT DOCUMENTS

| | | | |
|---|---|---|---|
| 326,021 | A | 9/1885 | Cruickshank |
| 504,397 | A | 9/1893 | Marsh |
| 1,008,370 | A | 11/1911 | Robillot |
| 2,386,818 | A | 10/1945 | Seavey |
| 2,556,244 | A | 6/1951 | Weston |
| 2,583,026 | A | 1/1952 | Swift |
| 2,690,592 | A | 10/1954 | Schanz |
| 2,708,176 | A | 5/1955 | Rhodes |
| 2,766,481 | A | 10/1956 | Henning |
| 2,804,494 | A | 8/1957 | Fenton |
| 3,035,115 | A | 5/1962 | Heckel et al. |
| 3,064,073 | A | 11/1962 | Downing et al. |
| 3,086,557 | A | 4/1963 | Peterson |
| 3,422,648 | A | 1/1969 | Lemelson |
| 3,473,986 | A | 10/1969 | Hureau |
| 3,644,659 | A | 2/1972 | Campbell |
| 3,650,862 | A | 3/1972 | Burr |
| 3,678,177 | A | 7/1972 | Lawrenson |
| 3,771,934 | A | 11/1973 | Delves-Broughton |
| 3,812,282 | A | 5/1974 | Johansson |

(Continued)

FOREIGN PATENT DOCUMENTS

| | | |
|---|---|---|
| BE | 539772 | 7/1959 |

(Continued)

OTHER PUBLICATIONS

International Search Report and Written Opinion mailed Dec. 4, 2008.

(Continued)

*Primary Examiner*—Chau N Nguyen
(74) *Attorney, Agent, or Firm*—Merchant & Gould P.C.

(57) ABSTRACT

A telecommunication wire having an electrical conductor is surrounded by an insulator. The insulator includes a main body made of a first polymeric insulator material. The main body defines a plurality of channels that run generally along a length of the electrical conductor. Each channel includes a first region and a second region. The first regions are filled with a second polymeric insulator material having a dielectric constant that is lower than the first polymeric insulator material. The second regions are filled with a gas such as air.

19 Claims, 6 Drawing Sheets

U.S. PATENT DOCUMENTS

| | | | |
|---|---|---|---|
| 3,892,912 | A | 7/1975 | Huack |
| 3,894,172 | A | 7/1975 | Jachimowicz et al. |
| 3,905,853 | A | 9/1975 | Stent |
| 3,911,070 | A | 10/1975 | Lundsager |
| 3,972,970 | A | 8/1976 | Taylor |
| 3,983,313 | A | 9/1976 | Ney et al. |
| 4,050,867 | A | 9/1977 | Ferrentino et al. |
| 4,132,756 | A | 1/1979 | Ferrentino et al. |
| 4,138,457 | A | 2/1979 | Rudd et al. |
| 4,181,486 | A | 1/1980 | Saito |
| 4,321,228 | A | 3/1982 | De Kok |
| 4,394,705 | A | 7/1983 | Blachman |
| 4,731,505 | A | 3/1988 | Kotthaus et al. |
| 4,745,238 | A | 5/1988 | Crenshaw et al. |
| 4,777,325 | A | 10/1988 | Siwinski |
| 4,892,442 | A | 1/1990 | Shoffner |
| 5,132,488 | A | 7/1992 | Tessier et al. |
| 5,162,120 | A | 11/1992 | Baxter et al. |
| 5,286,923 | A | 2/1994 | Prudhon et al. |
| 5,514,837 | A | 5/1996 | Kenny et al. |
| 5,563,377 | A | 10/1996 | Arpin et al. |
| 5,576,515 | A | 11/1996 | Bleich et al. |
| 5,742,002 | A | 4/1998 | Arredondo et al. |
| 5,744,757 | A | 4/1998 | Kenny et al. |
| 5,796,044 | A | 8/1998 | Cobian et al. |
| 5,796,046 | A | 8/1998 | Newmoyer et al. |
| 5,821,467 | A | 10/1998 | O'Brien et al. |
| 5,902,962 | A | 5/1999 | Gazdzinski |
| 5,922,155 | A | 7/1999 | Clouet et al. |
| 5,969,295 | A | 10/1999 | Boucino et al. |
| 5,990,419 | A | 11/1999 | Bogese, II |
| 6,064,008 | A | 5/2000 | Craton |
| 6,150,612 | A | 11/2000 | Grandy et al. |
| 6,153,826 | A | 11/2000 | Kenny et al. |
| 6,162,992 | A | 12/2000 | Clark et al. |
| 6,211,467 | B1 | 4/2001 | Berelsman et al. |
| 6,254,924 | B1 | 7/2001 | Brorein et al. |
| 6,303,867 | B1 | 10/2001 | Clark et al. |
| 6,323,427 | B1 | 11/2001 | Rutledge |
| 6,365,838 | B1 | 4/2002 | Rutledge et al. |
| 6,431,904 | B1 | 8/2002 | Berelsman |
| 6,452,105 | B2 | 9/2002 | Badii et al. |
| 6,465,737 | B1 | 10/2002 | Bonato et al. |
| 6,476,323 | B2 | 11/2002 | Beebe et al. |
| 6,476,326 | B1 | 11/2002 | Fuzier et al. |
| 6,534,715 | B1 | 3/2003 | Maunder et al. |
| 6,555,753 | B2 | 4/2003 | Rutledge et al. |
| 6,573,456 | B2 | 6/2003 | Spruell et al. |
| 6,639,152 | B2 | 10/2003 | Glew et al. |
| 6,743,983 | B2 | 6/2004 | Wiekhorst et al. |
| 6,815,617 | B1 | 11/2004 | Gebs et al. |
| 6,967,289 | B2 | 11/2005 | Goto |
| 7,049,519 | B2 | 5/2006 | Wiekhorst et al. |
| 7,196,271 | B2 | 3/2007 | Cornibert et al. |
| 7,214,880 | B2 | 5/2007 | Wiekhorst et al. |
| 7,238,886 | B2 | 7/2007 | Wiekhorst et al. |
| 7,511,221 | B2 | 3/2009 | Wiekhorst et al. |
| 7,511,225 | B2 | 3/2009 | Wiekhorst et al. |
| 7,560,648 | B2 | 7/2009 | Wiekhorst et al. |
| 7,604,435 | B2 * | 10/2009 | Mjelstad et al. ..... 405/195.1 |
| 2001/0011602 | A1 | 8/2001 | Vitolo |
| 2004/0055777 | A1 | 3/2004 | Wiekhorst et al. |
| 2004/0149483 | A1 | 8/2004 | Glew |
| 2004/0256139 | A1 | 12/2004 | Clark |
| 2005/0167148 | A1 | 8/2005 | Wiekhorst et al. |
| 2005/0269125 | A1 | 12/2005 | Clark |
| 2006/0118322 | A1 | 6/2006 | Wiekhorst et al. |
| 2006/0180329 | A1 | 8/2006 | Caveney |
| 2009/0025958 | A1 | 1/2009 | Wiekhorst et al. |
| 2010/0078193 | A1 | 4/2010 | Wiekhorst et al. |

FOREIGN PATENT DOCUMENTS

| | | |
|---|---|---|
| CA | 524452 | 5/1956 |
| DE | 2133453 | 1/1973 |
| EP | 1081720 | 3/2001 |
| GB | 725624 | 3/1955 |
| GB | 811703 | 4/1959 |

OTHER PUBLICATIONS

Wiekhorst et al, U.S. Appl. No. 12/562,752, filed Sep. 18, 2009, and titled "Communication Wire," which is copending and commonly assigned with the present application.

* cited by examiner

TELECOMMUNICATION WIRE WITH LOW DIELECTRIC CONSTANT INSULATOR

CROSS REFERENCE

This application claims priority to U.S. Provisional Patent Application Ser. No. 60/949,400, filed on Jul. 12, 2007, the disclosure of which is hereby incorporated by reference herein.

TECHNICAL FIELD

The present disclosure relates generally to twisted pair telecommunication wires for use in telecommunication systems. More particularly, the present disclosure relates to twisted pair telecommunication wires having channeled insulators.

BACKGROUND

Twisted pair cables are commonly used in the telecommunication industry to transmit data or other types of telecommunication signals. A typical twisted pair cable includes a plurality of twisted wire pairs enclosed within an outer jacket. Each twisted wire pair includes two insulated conductors that are twisted together at a predetermined lay length. Each insulated conductor includes an electrically conductive core made of a material such as copper, and a dielectric insulator surrounding the core.

The telecommunication industry is driven to provide telecommunication cable capable of accommodating wider ranges of signal frequencies and increased data transmission rates. To improve performance in a twisted wire pair, it is desirable to lower the dielectric constant (DK) of the insulator surrounding each electrical conductor of the twisted wire pair. As disclosed in U.S. Pat. No. 7,049,519, which is hereby incorporated by reference, the insulators of the twisted wire pairs can be provided with air channels. Because air has a DK value of 1, the air channels lower the overall DK value of the insulators thereby providing improved performance.

Providing an insulator with increased air content lowers the overall DK value of the insulator. However, the addition of too much air to the insulator can cause the insulator to have poor mechanical/physical properties. For example, if too much air is present in an insulator, the insulator may be prone to crushing. Thus, effective twisted pair cable design involves a constant balance between insulator DK value and insulator physical properties.

SUMMARY

One aspect of the present disclosure relates to a telecommunication wire having an electrical conductor surrounded by an insulator. The insulator includes a main body made of a first polymeric insulator material. The main body of the insulator defines a plurality of channels. The insulator also includes a second polymeric insulator material that only partially fills the channels defined by the main body. The second polymeric insulator material has a DK value that is lower than the first polymeric insulator material. In one embodiment, the first polymeric insulator material is a solid material, while the second polymeric insulator material is a foamed material.

Examples representative of a variety of inventive aspects are set forth in the description that follows. The inventive aspects relate to individual features as well as combinations of features. It is to be understood that both the forgoing general description and the following detailed description merely provide examples of how the inventive aspects may be put into practice, and are not intended to limit the broad spirit and scope of the inventive aspects.

DETAILED DESCRIPTION

Figure 1:
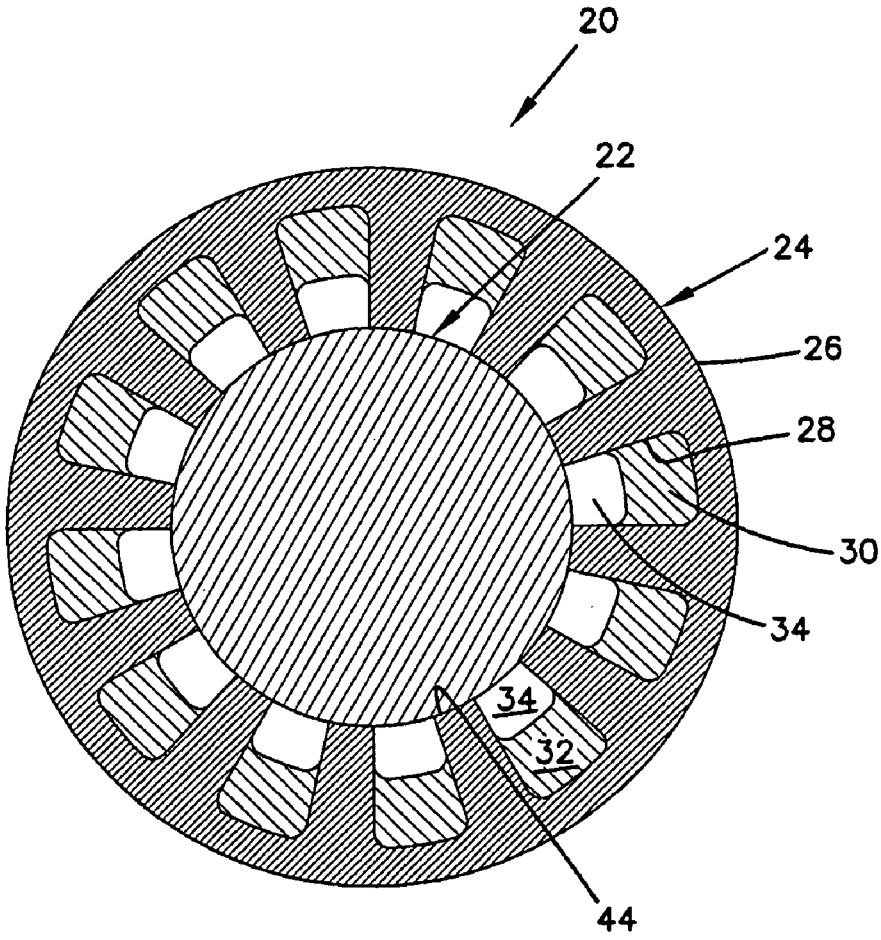
FIG. 1 is a transverse, cross-sectional view of a telecommunication wire having features that are examples of inventive aspects in accordance with the principles of the present disclosure.

FIG. 1 is a transverse, cross-sectional view of a telecommunication wire 20 having features that are examples of inventive aspects in accordance with the principles of the present disclosure. The telecommunication wire 20 includes an electrical conductor 22 surrounded by a dielectric insulator 24. The electrical conductor 22 is preferably manufactured of an electrically conductive metal material such as copper. It will be appreciated that the electrical conductor 22 can have either a solid or stranded configuration.

The dielectric insulator 24 also can be referred to as an insulation configuration, an insulation arrangement, or like terms. The dielectric insulator 24 includes a main body 26 constructed of a first dielectric insulator material. The main body 26 defines a plurality of channels 28 spaced circumferentially around a periphery of the electrical conductor 22. Each channel 28 includes a first region 30 filled with a second dielectric insulator material 32, and a second region 34 filled with a gaseous dielectric material such as air. At least a portion of the second dielectric insulator material 32 is a non-gaseous material. The second dielectric insulator material 32 preferably has a dielectric constant that is lower than the dielectric constant of the first dielectric insulator material forming the main body 26 of the dielectric insulator 24.

In one embodiment, the main body 26 of the dielectric insulator 24 is made of a solid polymeric material, while the second dielectric insulator material 32 of the dielectric insulator 24 includes a foamed polymeric material. For example, the main body 26 can include solid fluorinatedethylenepropylene (FEP) while the second dielectric insulator material 32 can include foamed FEP. Foamed FEP is manufactured with closed air pockets that provide voids within the dielectric material. In one embodiment, the second dielectric insulator material 32 is manufactured of foamed FEP having at least 20% air voids. In other embodiments, the second dielectric insulator material 32 can be manufactured of FEP having at least 30% air voids. In still other embodiments, the second dielectric insulator material 32 can be manufactured of FEP having 20% to 40% air voids. While FEP is a preferred material for both the main body 26 and the second dielectric insulator material 32, it will be appreciated that other materials also can be used. For example, other polymeric materials, such as other fluoropolymers, can be used. Still other polymeric materials that can be used for the main body 26 and the second dielectric insulator material 32 include polyolefins, such as polyethylene and polypropylene based materials. In certain embodiments, high density polyethylene also may be used.

The dielectric insulator 24 is constructed to have a relatively low dielectric constant in combination with exhibiting desirable mechanical properties such as enhanced crush resistance and suitable fire prevention characteristics. For example, the telecommunication wire 20 preferably allows cable to be manufactured that complies with the National Fire Prevention Association (NFPA) standards for how materials used in residential and commercial buildings burn. Example standards set by the NFPA include fire safety codes such as NFPA 255, 259 and 262. The UL910 Steiner tunnel burn test serves as the basis for the NFPA 255 and 262 standards.

It is preferred for the dielectric insulator 24 to have a dielectric constant less than 1.79. In a more preferred embodiment, the dielectric insulator 24 has a dielectric constant less than 1.75. In a still more preferred embodiment, the dielectric insulator 24 has a dielectric constant less than 1.7. In a further preferred embodiment, the dielectric insulator 24 has a dielectric constant less than 1.65. In a most preferred embodiment, the dielectric insulator 24 has a dielectric constant equal to or less than about 1.6. In calculating the dielectric constant, the volume of the dielectric insulator 24 equals the volume defined between the outer diameter of the electrical conductor 22 and the outer diameter of the main body 26 of the dielectric insulator 24.

Figure 2:
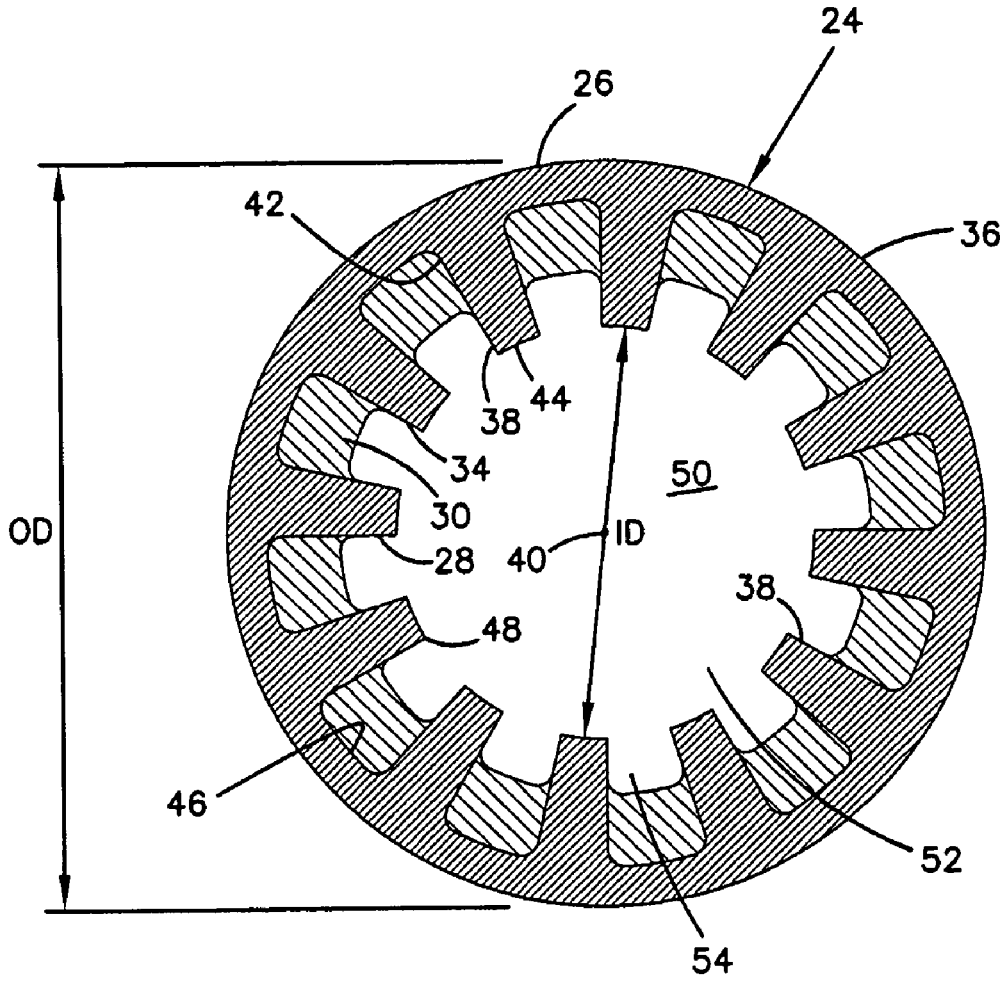
FIG. 2 is a transverse, cross-sectional view of an insulator of the telecommunication wire of FIG. 1 shown in isolation from an electrical conductor of the telecommunication wire of FIG. 1.

Referring to FIG. 2, the main body 26 of the dielectric insulator 24 includes an outer layer 36 having an outer surface that defines an outer diameter OD of the dielectric insulator 24. In certain embodiments, the outer diameter OD is in the range of 0.032 to 0.045 inches. The main body 26 also includes a plurality of projections or legs 38 that project radially inwardly from the outer layer 36 toward a center axis 40 of the dielectric insulator 24. The legs 38 have base ends 42 that are integrally formed with an inner side of the outer layer 36, and free ends 44 that are spaced radially inwardly from the base ends 42. As shown in FIG. 1, the free ends 44 are adapted to engage the outer diameter of the electrical conductor 22. The free ends 44 define an inner diameter ID of the dielectric insulator 24. The inner diameter ID generally corresponds to an outer diameter of the electrical conductor 22. In certain embodiments, the inner diameter ID ranges from 0.020 to 0.029 inches. Of course, the above size ranges are merely provided for example purposes, and other sizes are applicable as well.

Referring again to FIG. 2, the channels 28 of the dielectric insulator 24 are defined by the main body 26 at locations between the legs 38 of the main body 26. In certain embodiments, the dielectric insulator 24 defines at least eight channels 28. In the depicted embodiment, the dielectric insulator 24 defines twelve channels 28. The number of channels provided and the size of the channels are preferably selected to optimize crush resistance while providing a relatively low dielectric constant.

Referring still to FIG. 2, the channels 28 of the dielectric insulator 24 have closed ends 46 positioned at the outer layer 36 and open ends 48 that face radially inwardly toward the center axis 40. The dielectric insulator 24 defines an interior passage 50 having a central region 52 in which the electrical conductor 22 is located, and peripheral regions 54 defined by the channels 28. When the dielectric insulator 24 is shown in isolation from the electrical conductor 22, as provided in FIG. 2, the peripheral regions 54 are in fluid communication with the central region 52. With the dielectric insulator 24 mounted over the electrical conductor 22, the outer surface of the electrical conductor 22 bounds the inner, open ends 48 of the channels 28.

The channels 28 of the dielectric insulator 24 have lengths that run generally along a length of the electrical conductor 22. For certain twinning operations used to manufacture twisted pair cable, back twist can be applied to the telecommunication wire 20. In this situation, the channels 28 can extend in a helical pattern around the electrical conductor 22 as the channels 28 run generally along the length of the electrical conductor 22.

As shown in FIG. 1, the second dielectric insulator material 32 occupies the first region 30 of each channel 28. The first region 30 of each channel is located adjacent the outer layer 36 of the main body 26 and adjacent the base ends 42 of the legs 38. It is preferred for the first region 30 to be coextensive with only a portion of the total cross-sectional area of each of the channels 28. In one embodiment, the first region 30 corresponds to more than 40% but less than 90% of the total cross-sectional area of each of the channels 28. In still another embodiment, the first region 30 corresponds to more than 50% but less than 80% of the total cross-sectional area of each of the channels 28.

The second regions 34 of the channels 28 are located adjacent the free ends 44 of the legs 38. Thus, the second regions 34 are preferably positioned between the first regions 30 and the electrical conductor 22. As indicated above, the second regions 34 are preferably filled with a gaseous dielectric insulator, such as air. By positioning the second region 34 adjacent the open ends 48 of the channels 28, the outer surface of the electrical conductor 22 can be exposed to the gas located within the second regions 34.

In a preferred embodiment, the second regions 34 correspond to at least 15% of the total cross-sectional area defined between the inner and outer diameters ID, OD of the dielectric insulator 24. Additionally, in a preferred embodiment, the dielectric material 32 provided in the first region 30 is foamed and has closed cells containing a gas, such as air. It is preferred for the closed cells provided in the dielectric material 32 to occupy at least another 20% of the total cross-sectional area defined between the inner and outer diameters ID, OD of the dielectric insulator 24. By providing air in the second regions 34 and in the closed cells of the dielectric material 32, at least 35% of the cross-sectional area defined between the inner and outer diameters ID, OD of the dielectric insulator 24 can include air. Because air has a dielectric constant of 1, the provision of air within the dielectric insulator 24 assists in lowering the overall dielectric constant of the insulator 24. Moreover, the use of a foamed polymer as the second dielectric insulator material 32 assists in reinforcing the legs 38 to enhance the crush resistance of the dielectric insulator 24. Crush resistance is also enhanced by using a solid polymeric material as the first dielectric insulator material that forms the main body 26 of the dielectric insulator 24.

Figure 3A:
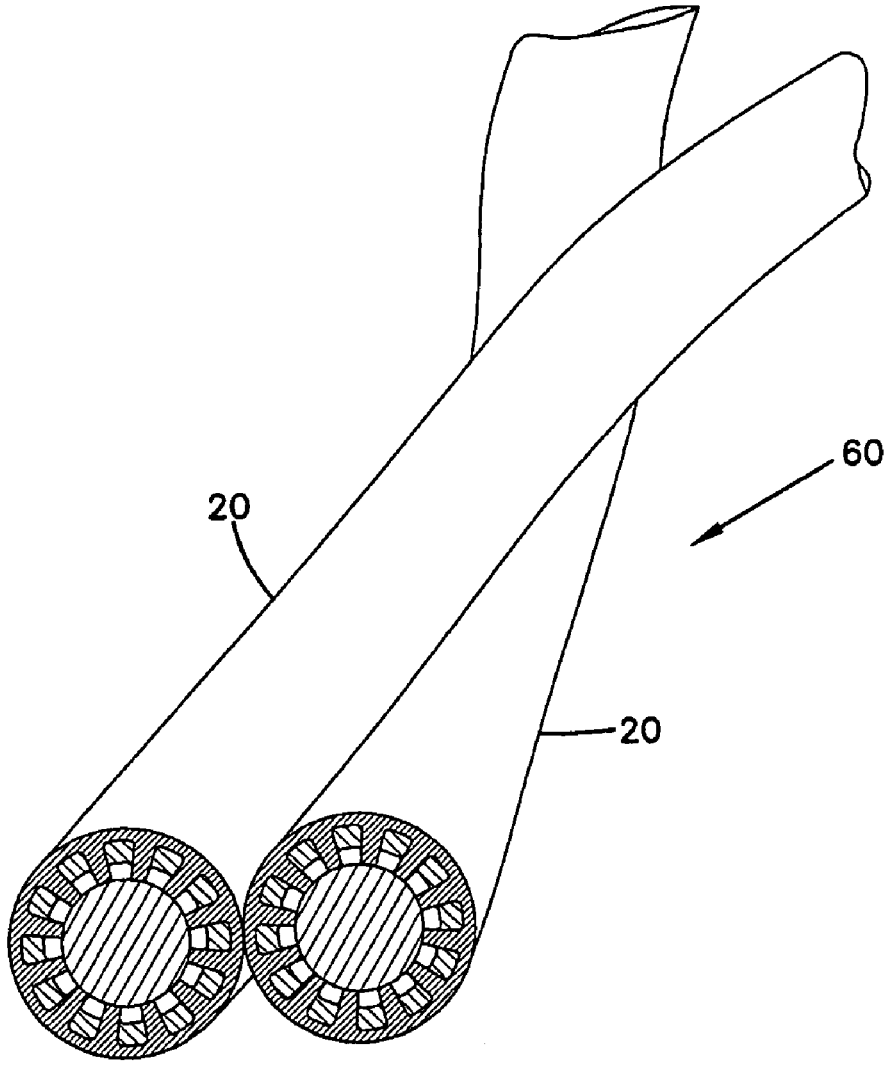
FIG. 3A is a perspective view of a twisted wire pair incorporating two telecommunication wires of the type shown at FIG. 1.
Figure 3B:
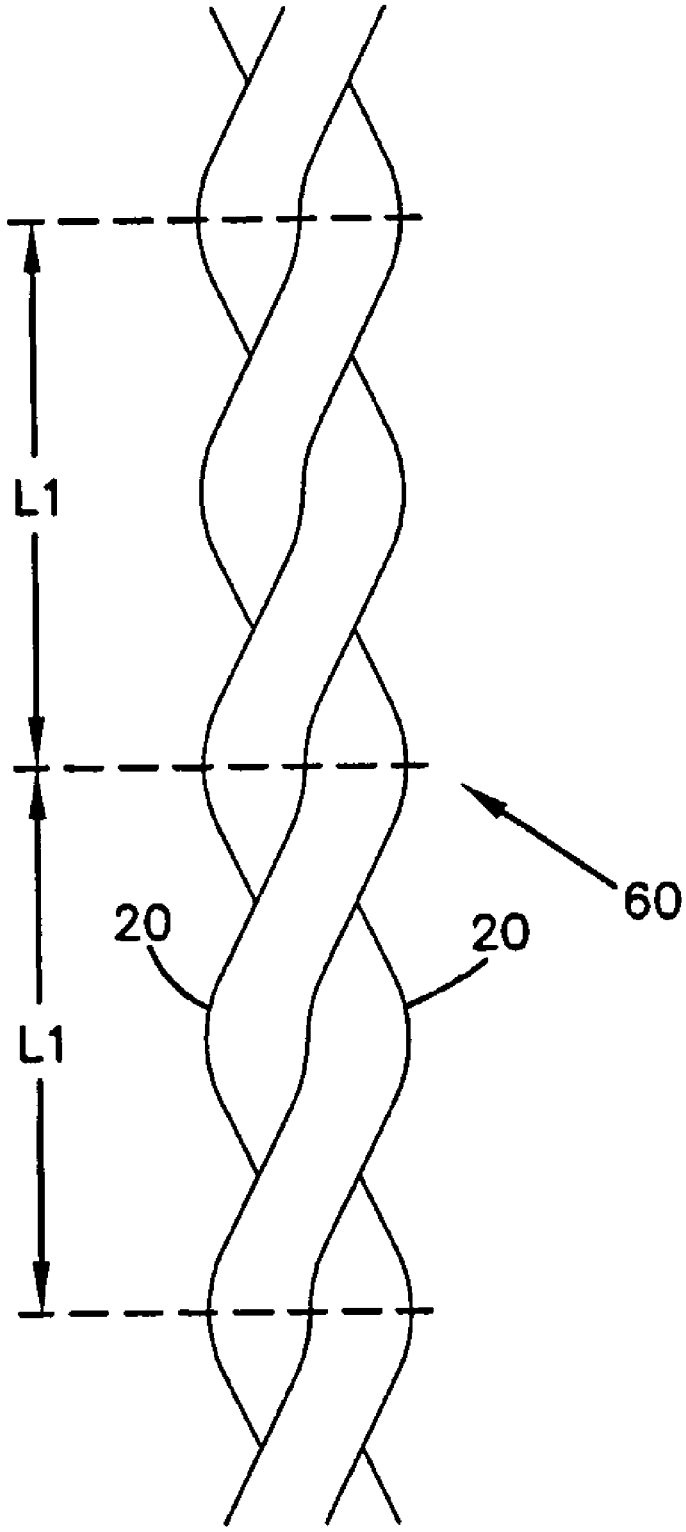
FIG. 3B is a view of a longer segment of the twisted wire pair of FIG. 3A.
Figure 4:
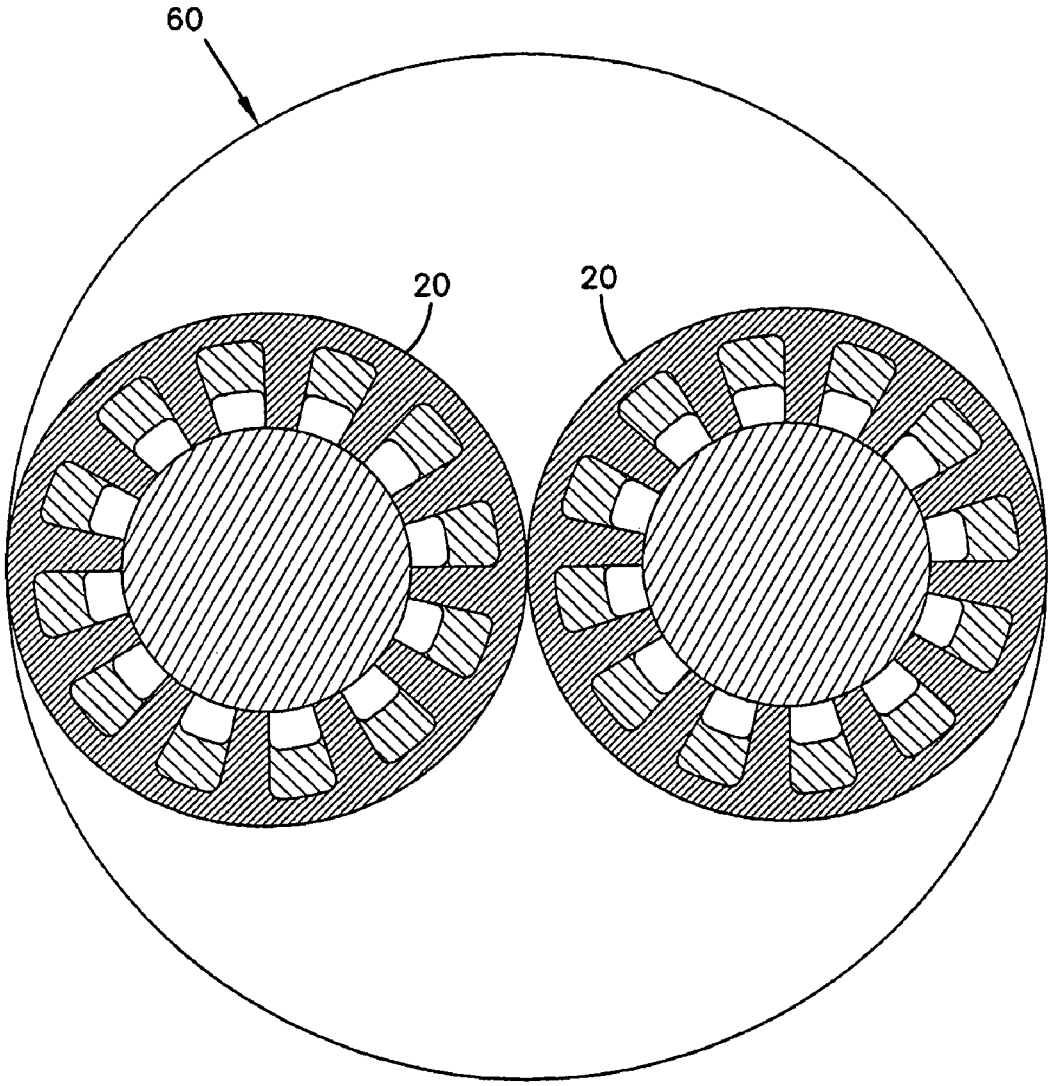
FIG. 4 is an end view of the twisted wire pair of FIG. 3 with an outer circle shown to represent a twist boundary defined by the twisted wire pair.

FIGS. 3A, 3B and 4 show two telecommunication wires 20 incorporated into a twisted wire pair 60. As shown in FIG. 3B, the telecommunication wires 20 are twisted about one another at a predetermined lay length L1. It will be appreciated that the lay length L1 can be generally constant, can be varied in a controlled manner, and also can be randomly varied. As shown in FIG. 4, an outer circle is representative of an outer boundary defined by the telecommunication wires 20 as the telecommunication wires are twisted around one another to form the twisted wire pair 60.

Figure 5:
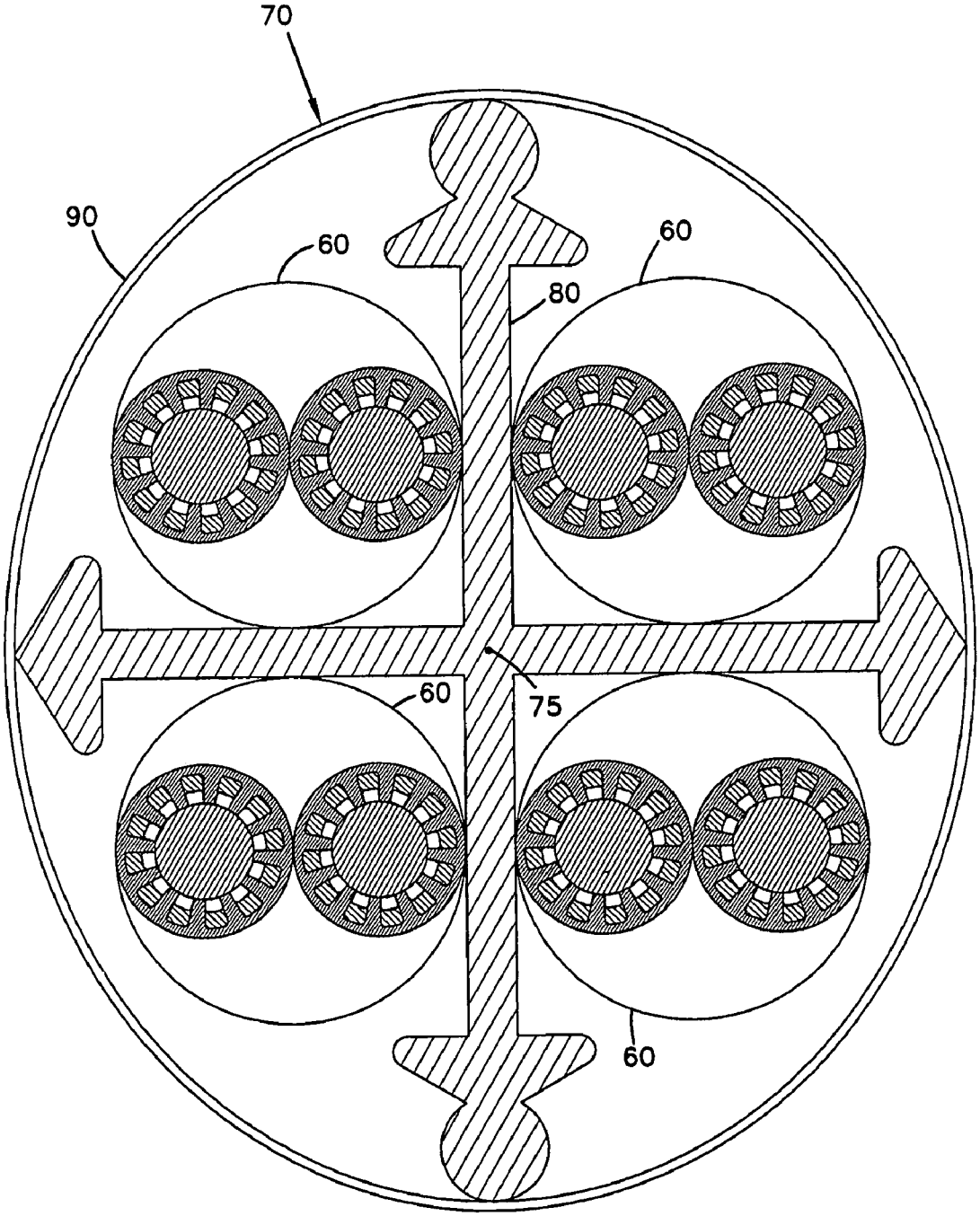
FIG. 5 is a transverse cross-sectional view of a telecommunication cable having a core that includes four twisted wire pairs of the type shown depicted in FIGS. 3A and 3B.

FIG. 5 shows four twisted wire pairs, such as the twisted wire pairs 60 shown in FIGS. 3A, 3B, and 4, incorporated into a four-pair telecommunication cable 70. The four twisted wire pairs 60 are separated by a filler 80 positioned within the cable 70. In one embodiment, the filler 80 is manufactured of a polymeric dielectric insulator material, such as foamed FEP. It will be appreciated that the filler 80 and the four twisted wire pairs 60 define a cable core that is twisted about a center axis 75 of the cable 70 at a predetermined lay length. It will be appreciated that the lay length can be randomly varied, maintained at a constant lay, or varied in a controlled, non-random manner. An outer jacket 90 covers the cable core.

It will be appreciated that each telecommunication wire 20 can be manufactured using an extrusion process. Example extrusion processes for manufacturing channeled telecommunication wires are disclosed at U.S. Pat. No. 7,049,519, which was previously incorporated by reference herein.

The above specification provides examples of how certain inventive aspects may be put into practice. It will be appreciated that the inventive aspects can be practiced in other ways than those specifically shown and described herein without departing from the spirit and scope of the inventive aspects.

What is claimed is:

1. A telecommunication wire comprising:

an electric conductor; and a dielectric insulator surrounding the electrical conductor, the dielectric insulator including a main body defining a plurality of channels that run generally along a length of the electrical conductor, the main body being constructed of a first polymeric material;

the channels defined by the main body of the insulator each including first and second regions, the first regions being occupied by a second polymeric material having a dielectric constant lower than a dielectric constant of the first polymeric material, and the second regions being occupied by a gas, wherein the channels have open ends that face toward the electrical conductor.

2. The telecommunication wire of claim 1, wherein the gas is air.

3. The telecommunication wire of claim 1, wherein the first polymeric material includes a solid fluoropolymer, and the second dielectric material includes a foamed fluoropolymer.

4. The telecommunication wire of claim 3, wherein the first polymeric material includes FEP and the second polymeric material includes foamed FEP.

5. The telecommunication wire of claim 1, wherein the insulator has a dielectric constant less than 1.79.

6. The telecommunication wire of claim 1, wherein the second regions of the channels are filled with air, and wherein the second regions of the channels are positioned between the first regions of the channel and the electrical conductor.

7. The telecommunication wire of claim 1, wherein the dielectric insulator defines at least eight channels.

8. The telecommunication wire of claim 1, wherein the dielectric insulator defines twelve channels.

9. A telecommunication wire comprising:

an electrical conductor having a periphery; and a dielectric insulator arrangement surrounding the electrical conductor, the dielectric insulator arrangement including an outer layer and a plurality of legs that project radially inwardly from the outer layer toward a center axis of the dielectric insulator arrangement, the outer layer being formed from a first polymeric material, the legs defining a plurality of channels spaced circumferentially around a periphery of the electrical conductor, the channels having closed ends positioned at the outer layer and open ends that face radially inwardly toward a center axis, each channel including first and second regions, the first regions being occupied by a second polymeric material having a dielectric constant lower than a dielectric constant of the first polymeric material, and the second regions being occupied by a gas.

10. The telecommunication wire of claim 9, wherein the gas is air.

11. The telecommunication wire of claim 9, wherein the second polymeric material is a foamed polymer.

12. The telecommunication wire of claim 9, wherein free ends of the legs are adapted to engage an outer diameter of the electrical conductor.

13. The telecommunication wire of claim 9, wherein the outer layer and legs of the dielectric insulator are formed from a solid fluoropolymer.

14. The telecommunication wire of claim 9, wherein the dielectric insulator has a dielectric constant less than 1.79.

15. A telecommunication cable comprising:

an outer jacket; and a cable core surrounded by the outer jacket and being twisted about a center axis of the telecommunication cable at a predetermined lay length, the cable core including a plurality of twisted wire pairs separated by a filler, each of the twisted pairs including first and second telecommunication wires, at least one of the telecommunication wires including:

an electrical conductor; and a dielectric insulator surrounding the electrical conductor, the dielectric insulator being formed of a first polymeric material and defining channels extending along a length of the electrical conductor, each channel defining a first region at least partially filled with a dielectric non-gaseous material and a second region at least partially filled with a dielectric gas, the dielectric non-gaseous material including a different polymeric material than the first polymeric material.

16. The telecommunication cable of claim 15, wherein the cable core includes four twisted wire pairs.

17. The telecommunication cable of claim 15, wherein the dielectric non-gaseous material includes a dielectric foam.

18. The telecommunication cable of claim 15, wherein the first region of each channel corresponds to more than 40% but less than 90% of a total cross-sectional area of the channel.

19. The telecommunication cable of claim 15, wherein the first region of each channel corresponds to more than 50% but less than 80% of a total cross-sectional area of the channel.

* * * * *